United States Patent [19]

Wade

[11] Patent Number: 4,926,910

[45] Date of Patent: May 22, 1990

[54] RADIO-FREQUENCY REFLECTIVE FABRIC

[75] Inventor: William D. Wade, San Jose, Calif.

[73] Assignee: Lockheed Missiles & Space Company, Inc., Sunnyvale, Calif.

[21] Appl. No.: 234,599

[22] Filed: Aug. 22, 1988

Related U.S. Application Data

[62] Division of Ser. No. 123,843, Nov. 23, 1987.

[51] Int. Cl.[5] ..... D03D 15/00; D02G 3/12; D02G 3/36

[52] U.S. Cl. ..... 139/425 R; 57/210; 57/230; 57/901; 139/426 R; 428/225

[58] Field of Search ..... 57/210–212, 57/238, 224, 901, 230, 902; 139/425 R, 426 R; 428/224, 225

[56] References Cited

U.S. PATENT DOCUMENTS

| | | | |
|---|---|---|---|
| 4,202,382 | 5/1980 | Westhead | 57/210 X |
| 4,381,639 | 5/1983 | Kress | 57/210 X |
| 4,384,449 | 5/1983 | Byrnes, Sr. et al. | 57/210 |
| 4,470,251 | 9/1984 | Bettcher | 57/210 X |
| 4,776,160 | 10/1988 | Rees | 57/210 |
| 4,793,130 | 12/1988 | Togashi et al. | 57/210 |

*Primary Examiner*—John Petrakes
*Attorney, Agent, or Firm*—John J. Morrissey

[57] ABSTRACT

A radio-frequency reflective surface is made of a fabric woven from a yarn having an effective coefficient of thermal expansion of substantially zero over a useful temperature range. The yarn comprises a metallic filament around which non-metallic rovings are wound. The coefficients of thermal expansion of the filament and the roving material are related to each other so that mechanical strain thermally induced in the filament by changes in temperature is counteracted by mechanical strain theremally induced in the rovings. Intermodulation products at yarn intersections of the fabric are substantially zero.

15 Claims, 1 Drawing Sheet

RADIO-FREQUENCY REFLECTIVE FABRIC

This is a division of application Ser. No. 123,843, filed Nov. 23, 1987.

TECHNICAL FIELD

This invention relates generally to radio-frequency reflectors, and more particularly to a fabric for use as a radio-frequency reflective surface in extraterrestrial applications.

BACKGROUND OF THE INVENTION

Knitted wire meshes have been used in the prior art for radio-frequency reflective surfaces in earth satellite applications. For example, the reflector of the Tracking Data Relay Satellite System, and also the Galileo reflector marketed by Harris Corporation of Melborne, Fla., use a wire mesh reflective surface made of gold-plated molybdenum. TRW Corporation has marketed a so-called tulip reflector having a radio-frequency reflective surface made of a welded-wire fabric comprising filaments made of stainless steel and silver.

Knitted wire meshes of the prior art have exhibited a phenomenon known as "pillowing" when subjected to biaxial loads applied over curved frameworks. "Pillowing" of a mesh is a distortion characterized by bulges (or "pillows") that occur in the mesh due to mechanical strain. "Pillowing" in a knitted wire mesh used as a radio-frequency reflective surface generally degrades performance, and causes side lobes of radio-frequency energy reflected from the mesh.

Knitted wire meshes used as radio-frequency reflective surfaces in the prior art have also exhibited significant intermodulation products at knit junctions of the meshes. Intermodulation products generally cause excessively high noise levels in radio-frequency receiving channels. Many presently operating satellite systems (e.g., INMARSAT, INTELSAT and COMMSAT) have such high noise levels attributable to intermodulation products that operational capabilities of receiving channels are seriously impaired.

SUMMARY OF THE INVENTION

It is an object of the present invention to provide a yarn having a coefficient of thermal expansion of effectively zero over a useful temperature range, which yarn can be woven into a fabric for use as a radio-frequency reflective surface.

It is a particular object of the present invention to provide a fabric for use as a radio-frequency reflective surface for an antenna to be deployed in extraterrestrial space, where the fabric has an effective coefficient of thermal expansion of zero over a useful operating temperature range for the reflective surface, and where intermodulation products produced on the reflective surface are practically insignificant.

It is a further object of the present invention to provide a fabric drapery woven from a yarn according to the present invention for enclosing a region in which an emitter of radio-frequency electromagnetic radiation is located, where the drapery functions as a shield to prevent leakage of radio-frequency energy from the enclosed region.

In accordance with the present invention, a yarn having an effectively zero coefficient of thermal expansion is formed by combining a metallic filament having a positive coefficient of thermal expansion with rovings made of a non-metallic material having a negative coefficient of thermal expansion, where the coefficient of thermal expansion and the tensile modulus of the metallic filament are related to the coefficient of thermal expansion and the tensile modulus of the non-metallic rovings so that mechanical strain thermally induced in the metallic filament is substantially counteracted by mechanical strain thermally induced in the non-metallic rovings at temperatures in a range at which a fabric woven from the yarn is designed to operate as a radio-frequency reflective surface.

In exemplary embodiments of yarns according to the present invention, the metallic filament is made of: (a) copper, (b) silver, (c) molybdenum, (d) an alloy of copper and beryllium, or (e) gold-plated molybdenum; and the non-metallic rovings are made of: (a) graphite, or (b) Kevlar aramid.

BEST MODE OF CARRYING OUT THE INVENTION

An antenna reflector intended for deployment in extraterrestrial space should ideally have certain features that might not be particularly important in an antenna reflector used for terestrial applications. Thus, for example, an antenna reflector designed for deployment in extraterrestrial space should be light-weight, and should be packageable in a relatively small volume prior to deployment. Furthermore, an antenna reflector designed for deployment in extraterrestrial space should be made of materials that are chemically stable under exposure to ultraviolet radiation, and should be dimensionally stable under thermal stresses induced by extreme temperature fluctuations.

Figure 1:
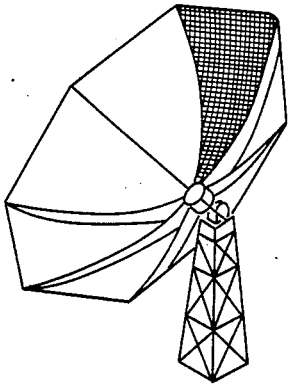
FIG. 1 is a perspective view of an antenna reflector having a radio-frequency reflective surface that is made of a fabric woven from a yarn according to the present invention.

FIG. 1 is a generalized illustration of an antenna reflector, which has a radio-frequency reflective surface comprising a plurality of sectors made of a flexible woven fabric stretched over a light-weight framework. The fabric is chemically stable under exposure to ultraviolet radiation, and is dimensionally stable under thermal stresses induced by extreme temperature fluctuations when the antenna reflector is deployed. Chemical stability of the fabric under ultraviolet radiation is provided by covering the fabric with an elastomeric paint such as Dow Corning DC6-1104 formulation. The framework, which forms ribs for supporting the fabric, can be made of a graphite-epoxy composite material. The fabric is foldable, thereby enabling the framework with the fabric attached thereto to be collapsed into a storage configuration that occupies a much smaller volume than is required when the framework is opened to a deployment configuration in which the fabric is stretched taut to form the reflective surface.

Figure 2:
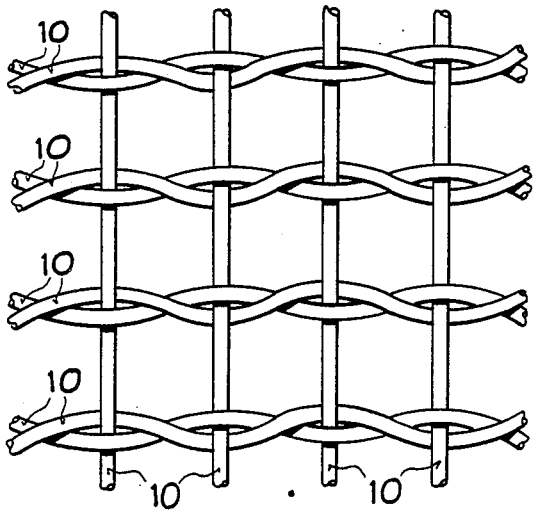
FIG. 2 is an enlarged view of a portion of the fabric from which the radio-frequency reflective surface shown in FIG. 1 is made.

The fabric from which the radio-frequency reflective surface of the antenna reflector shown in FIG. 1 is made is woven from a yarn 10 according to a pattern that may be conventional. A typical weave for the fabric, viz., a conventional Marquisette Leno weave, is illustrated in enlarged view in FIG. 2. The yarn 10 comprises a metallic filament around which rovings made of a non-metallic dielectric material are wound. The metallic filament provides the fabric with the required radio-frequency reflective property to enable the fabric to function as a reflective surface. The non-metallic rovings working in concert with the metallic filament provide dimensional stability for the fabric under thermal stresses.

Figure 3:
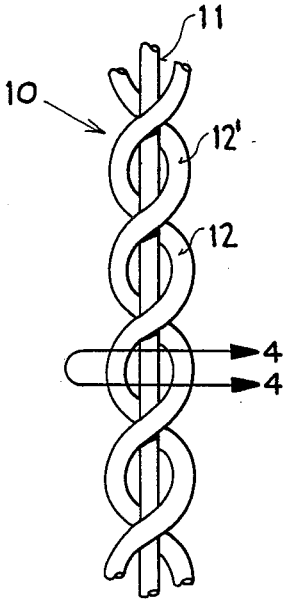
FIG. 3 illustrates a segment of a yarn from which the fabric shown in FIG. 2 is woven.

In principle, a single non-metallic roving could be used for the yarn 10. However, in the preferred embodiment as illustrated in FIG. 3, the yarn 10 comprises a longitudinally extending metallic filament 11 around which two rovings (e.g., a roving 12 would in a clockwise direction, and a roving 12' wound in a counterclockwise direction) are wrapped. The metallic filament 11 typically has a diameter on the order of 0.001 inch, and the rovings 12 and 12' are of about 55 denier. The filament 11 and the rovings 12 and 12' have coefficients of thermal expansion that substantially counterbalance each other, thereby resulting in an effective coefficient of thermal expansion of zero over a useful temperature range for the fabric woven from the yarn 10 when the yarn 10 is subjected to thermal loading forces that occur when the antenna reflector is deployed. The fabric woven from the yarn 10 is intended primarily for use as the reflective surface of an antenna reflector for extraterrestrial applications in which large temperature fluctuations are to be expected, generally in the range from about −150° C. to about 100° C.

If a fabric for use as a radio-frequency reflective surface were to be woven from a metallic filament that is not covered by an electrically insulating covering, intermodulation products would be produced at yarn intersections of the fabric, i.e., where crossing elements of the metallic filament come into contact with each other. Such intermodulation products would produce unacceptable noise levels in the receiver bands of the antenna, which could make it necessary for separate antennas to be used for the transmitter and receiver bands. Such intermodulation products could in principle be eliminated by winding or otherwise covering the metallic filament with any sort of dielectric that would prevent contact between crossing elements of the metallic filament. However, it is not sufficient simply to eliminate intermodulation products. Unless the roving material is also capable of accepting approximately half of the loading forces imposed upon the yarn by stresses thermally induced in the fabric, the metallic filament would bear most of the loading forces and the net coefficient of thermal expansion of the fabric would have substantially the value of the coefficient of thermal expansion of the metallic filament.

The filament 11 illustrated in FIG. 3 is made from a metal whose coefficient of thermal expansion over a useful temperature range is substantially counteracted by the coefficient of thermal expansion of the rovings 12 and 12' over the same temperature range, so that the effective coefficient of thermal expansion for the yarn 10 over that temperature range is substantially zero. The useful temperature range for a radio-frequency reflective surface designed to operate in extraterrestrial space is from about −150° C. to about 100° C. Therefore, an investigation was made of changes in the coefficients of thermal expansion with respect to temperature over the range from −150° C. to 100° C. for a variety of materials that were considered as possible candidates to use for the metal filament 11 and the non-metal rovings 12 and 12' of the yarn 10 of the present invention. As a result of the investigation, it was determined that:

1. The filament 11 could be made from: (a) copper, (b) silver, (c) molybdenum, (d) an alloy of copper and beryllium, or (e) gold-plated molybdenum; and
2. The rovings 12 and 12' could be made from: (a) graphite, or (b) a Kevlar aramid, where "Kevlar" is a trademark of Du Pont Corporation.

The coefficient of thermal expansion and the tensile modulus for each of the five above-listed candidate materials for the metallic filament 11 are listed in tabular format as follows:

TABLE I

| METAL FILAMENTS | | | |
|---|---|---|---|
| | Coefficient of Thermal Expansion | Tensile Modulus | |
| Material | $10^{-6}$/deg C. | psi | mPa |
| Copper | 17.64 | $17.0 \times 10^6$ | 117,500 |
| Silver | 19.62 | $11.0 \times 10^6$ | 76,000 |
| Molybdenum | 5.04 | $50.0 \times 10^6$ | 354,700 |
| Cu and Be Alloy | 17.64 | $18.5 \times 10^6$ | 127,900 |
| Au-plated Mb | 5.04 | $50.0 \times 10^6$ | 345,700 |

where the tensile modulus for each material is given in pounds per square inch (psi) and also in magapascals (mPa).

The cofficient of thermal expansion and the tensile modulus for each of the candidate materials for the non-metallic rovings 12 and 12' are listed in tabular format as follows:

TABLE II

| NON-METAL ROVINGS | | | |
|---|---|---|---|
| | Coefficient of Thermal Expansion | Tensile Modulus | |
| Material | $10^{-6}$/ deg C. | psi | mPa |
| Graphite | * | * | |
| Kevlar | −4.21 | $17.5 \times 10^6$ | 121,000 |

*No particular values for the coefficient of thermal expansion and the tensilemodulus are given for graphite, because such values are dependent upon the processused to form the graphite from a hydrocarbon material (typically, rayon fibers).The values for the coefficient of thermal expansion and the tensile modulus of graphitecan generally, within limits, be tailored to meet a specific requirement.

The condition that must be met in order for mechanical strain thermally induced in the filament 11 to be counteracted by mechanical strain thermally induced in the rovings 12 and 12' of the yarn 10 so that the fabric woven from the yarn 10 retains dimensional stability while undergoing large temperature fluctuations is that $$|\alpha_F A_F E_F| = |\alpha_R A_R E_R|$$

where $\alpha_F$ and $\alpha_R$ are the coefficients of thermal expansion of the filament 11 and of the rovings 12 and 12', respectively; where $A_F$ and $A_R$ are the cross-sectional areas of the filament 11 and of the rovings 12 and 12', respectively; and where $E_F$ and $E_R$ are the tensile moduli of the filament 11 and of the rovings 12 and 12', respectively. For any given roving material, the product $A_R E_R$ is effectively determined by the manufacturer. In general, for a fabric to be used in extraterrestrial applications, it is desirable that the rovings 12 and 12' have a weight that is as light as possible and a diameter that is as fine as possible. For graphite and Kevlar fibers, a density of 55 denier provides about as light a weight and as fine a diameter as can be obtained commercially at the present time.

Combining the data from Tables I and II enables an "effective" coefficient of thermal expansion to be determined for a yarn comprising a filament selected from Table I and a roving material selected from Table II. Thus, for a yarn comprising a Be/Cu filament that is 0.001 inch in diameter and has two rovings made of 55 denier Kevlar material, the effective coefficient of thermal expansion is seen to be substantially zero over the temperature range from −150° C. to 100° C. Similarly, an effective zero coefficient of thermal expansion over the same temperature range can be achieved using a yarn comprising a 0.0012-inch diameter filament made of silver and two rovings made of 55 denier Kevlar.

Figure 4:
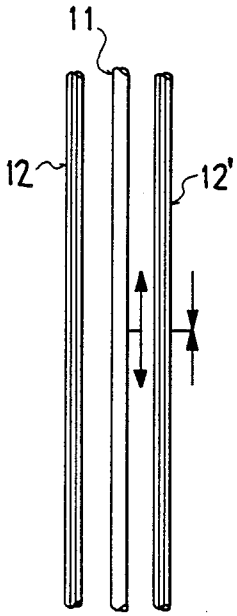
FIG. 4 schematically illustrates counteracting strains thermally induced in the metallic filament and the non-metallic rovings of a portion of the yarn segment shown within the line 4—4 in FIG. 3.

When a fabric woven from the yarn shown in FIG. 3 is placed under a tensile loading (as occurs when a radio-frequency reflective surface made of such a fabric is deployed), a rise in temperature causes the metallic filament 11 to experience a mechanical stress that expands the filament 11 longitudinally. The same rise in temperature, however, causes the rovings 12 and 12' to experience a contraction due to an oppositely directed mechanical stress. A small portion of the yarn 10 enclosed within line 4—4 of FIG. 3 is shown in magnified view in FIG. 4 along with arrows representing stress forces tending to elongate the metallic filament 11 longitudinally and to contract the rovings 12 and 12' in the opposite direction. As indicated in FIG. 4, the net result of thermally induced stresses on the yarn 10 is that the yarn 10 retains dimensional stability, i.e., undergoes no significant expansion or contraction.

The particular embodiments described herein of a yarn having a substantially zero coefficient of thermal expansion over a useful termperature range, and of a fabric woven from such a yarn, are illustrative of the invention, which is defined more generally by the following claims and their equivalents.

I claim:

1. A yarn for use in weaving a fabric that reflects radio-frequency electromagnetic energy, said yarn comprising a metallic filament and a non-metallic roving material, said roving material being wound around said metallic filament so as to form an electrically insulating covering for said metallic filament, said metallic filament having a diameter and said roving material having a density that are related to each other such that approximately half of any loading forces imposed upon said yarn by thermal stresses applied to the fabric woven from said yarn are accepted by said roving material, said filament and said roving material having corresponding coefficients of thermal expansion that are related to each other so that mechanical strain thermally induced in said metallic filament is substantially counteracted by mechanical strain thermally induced in said roving material as a result of thermal stresses applied to the fabric woven from said yarn at temperatures in a range extending from about −150° C. to about 100° C., said yarn thereby having an effective coefficient of thermal expansion of substantially zero over said range of temperatures.

2. The yarn of claim 1 wherein said metallic filament has a positive coefficient of thermal expansion, and wherein said roving material has a negative coefficient of thermal expansion.

3. The yarn of claim 2 wherein said metallic filament is made of a metal selected from a group consisting of: (a) copper, (b) silver, (c) molybdenum, (d) an alloy of copper and beryllium, and (e) gold-plated molybdenum.

4. The yarn of claim 3 wherein said roving material is made of a material selected from a group consisting of: (a) graphite, and (b) an aramid.

5. The yarn of claim 1 wherein said roving material comprises two rovings wound in opposite directions around said metallic filament.

6. A fabric that reflects radio-frequency electromagnetic energy, said fabric having an effective coefficient of thermal expansion of substantially zero at temperatures in a range extending from about −150° C. to about 100° C., said fabric being woven from a yarn comprising a metallic filament and a non-metallic roving material, said roving material being wound around said metallic filament so as to form an electrically insulating covering for said metallic filament, said metallic filament having a diameter and said roving material having a density that are related to each other such that approximately half of any loading forces imposed upon said yarn by thermal stresses applied to said fabric are accepted by said roving material, said filament and said roving material having corresponding coefficients of thermal expansion that are related to each other so that mechanical strain thermally induced in said metallic filament is substantially counteracted by mechanical strain thermally induced in said roving material as a result of thermal stresses applied to said fabric at temperatures in said temperature range.

7. The fabric of claim 6 wherein said metallic filament has a positive coefficient of thermal expansion, and wherein said roving material has a negative coefficient of thermal expansion.

8. The fabric of claim 7 wherein said metallic filament is made of a metal selected from a group consisting of: (a) copper, (b) silver, (c) molybdenum, (d) an alloy of copper and beryllium, and (e) gold-plated molybdenum.

9. The fabric of claim 8 wherein said roving material is made of a material selected from a group consisting of: (a) graphite, and (b) an aramid.

10. The fabric of claim 6 wherein said roving material comprises two rovings wound in opposite directions around said metallic filament.

11. A drapery for enclosing a region in which an emitter of radio-frequency electromagnetic energy is positioned, said drapery thereby functioning as a shielding to prevent leakage of radio-frequency electromagnetic energy from said region, said drapery being made of a fabric that is woven from a yarn comprising a metallic filament and a non-metallic roving material, said roving material being wound around said metallic filament so as to form an electrically insulating covering for said metallic filament, said metallic filament having a diameter and said roving material having a density that are related to each other such that appoximately half of any loading forces imposed upon said yarn by thermal stresses applied to said drapery are accepted by said roving material, said filament and said roving material having corresponding coefficients of thermal expansion that are related to each other so that mechanical strain thermally induced in said metallic filament is substantially counteracted by mechanical strain thermally induced in said roving material as a result of thermal stresses applied to said drapery at temperatures in a range extending from about −150° C. to about 100° C.

12. The drapery of claim 11 wherein said metallic filament has a positive coefficient of thermal expansion, and wherein said roving material has a negative coefficient of thermal expansion.

13. The drapery of claim 12 wherein said metallic filament is made of a metal selected from a group consisting of: (a) copper, (b) silver, (c) molybdenum, (d) an alloy of copper and beryllium, and (e) gold-plated molybdenum.

14. The drapery of claim 13 wherein said roving material is made of a material selected from a group consisting of: (a) graphite, and (b) an aramid.

15. The drapery of claim 11 wherein said roving material comprises two rovings wound in opposite directions around said metallic filament.

* * * * *